US009386890B2

(12) United States Patent
Pommer et al.

(10) Patent No.: US 9,386,890 B2
(45) Date of Patent: Jul. 12, 2016

(54) DISPENSING UNIT AND DISPENSER

(75) Inventors: Stig Pommer, Borlänge (SE); Erik Hjort, Borlänge (SE); Marcus Kullman, Borlänge (SE); Matti Karonen, Vikmanshyttan (SE); Sylvia Jonsson, Göteborg (SE)

(73) Assignee: SCA HYGIENE PRODUCTS AB, Gothenburg (SE)

( * ) Notice: Subject to any disclaimer, the term of this patent is extended or adjusted under 35 U.S.C. 154(b) by 21 days.

(21) Appl. No.: 14/405,284

(22) PCT Filed: Jun. 4, 2012

(86) PCT No.: PCT/SE2012/050595

§ 371 (c)(1),
(2), (4) Date: Jan. 30, 2015

(87) PCT Pub. No.: WO2013/184049

PCT Pub. Date: Dec. 12, 2013

(65) Prior Publication Data

US 2015/0150423 A1 Jun. 4, 2015

(51) Int. Cl.

| | |
|---|---|
| ***B65H 16/02*** | (2006.01) |
| ***A47K 10/38*** | (2006.01) |
| *A47K 10/32* | (2006.01) |

(52) U.S. Cl.

CPC ..... *A47K 10/3818* (2013.01); *A47K 2010/3206* (2013.01); *A47K 2010/3863* (2013.01)

(58) Field of Classification Search

CPC ... A47K 10/24; A47K 10/38; A47K 10/3818; B65H 23/10; Y10T 225/21; Y10T 225/206; Y10T 225/213

USPC ..... 242/593, 564, 564.1, 565, 615.3

See application file for complete search history.

(56) References Cited

U.S. PATENT DOCUMENTS 535,335 A * 3/1895 Hoyt ..... 242/328.2
1,975,414 A * 10/1934 Wade ..... A47K 10/36 226/129

(Continued)

FOREIGN PATENT DOCUMENTS

WO WO 97/26818 A1 7/1997

OTHER PUBLICATIONS

International Search Report (PCT/ISA/210) mailed on Jan. 1, 2013, by the Swedish Patent Office as the International Searching Authority for International Application No. PCT/SE2012/050595.

(Continued)

*Primary Examiner* — William A Rivera

(74) *Attorney, Agent, or Firm* — Buchanan Ingersoll & Rooney PC

(57) ABSTRACT

A dispensing unit and a dispenser are provided. The dispensing unit is adapted for use with continuous web material. The dispensing unit comprises a first roller arranged to rotate about a first axis and a second roller arranged to rotate about a second axis. A web path is provided through the dispensing unit and a portion of the web path includes a web passage defined between the first roller and the second roller. The first roller is displaceable between at least a first position and a second position, wherein a first distance is defined between the first roller and the second roller when the first roller is arranged in the first position, and a second distance is defined between the first roller and the second roller when the first roller is arranged in the second position.

20 Claims, 9 Drawing Sheets

(56) References Cited

U.S. PATENT DOCUMENTS

| | | | | |
|---|---|---|---|---|
| 3,730,409 | A * | 5/1973 | Ratti | A47K 10/36 225/10 |
| 4,432,482 | A * | 2/1984 | Beausoleil | A47K 10/36 225/46 |
| 5,370,338 | A | 12/1994 | Lewis | |
| 5,577,634 | A | 11/1996 | Morand | |
| 6,695,247 | B2 | 2/2004 | Widlund | |
| 7,275,655 | B2 | 10/2007 | Duff | |
| 7,275,672 | B2 | 10/2007 | Haen et al. | |
| 2003/0066924 | A1 | 4/2003 | Widlund | |
| 2003/0071102 | A1 | 4/2003 | Haen et al. | |
| 2005/0067424 | A1 | 3/2005 | Duff | |
| 2010/0258579 | A1 | 10/2010 | Billman et al. | |
| 2012/0223175 | A1 | 9/2012 | Billman et al. | |

OTHER PUBLICATIONS

Written Opinion (PCT/ISA/237) mailed on Jan. 1, 2013, by the Swedish Patent Office as the International Searching Authority for International Application No. PCT/SE2012/050595.

International Preliminary Report on Patentability (PCT/IPEA/409) mailed on Jul. 10, 2014 for International Application No. PCT/SE2012/050595.

* cited by examiner

DISPENSING UNIT AND DISPENSER

TECHNICAL FIELD

The present invention relates to a dispensing unit and a dispenser for a continuous web material.

BACKGROUND

A continuous web material such as tissue paper or non-woven material may be provided in perforated and non-perforated form. Perforated web material is arranged to break at perforations during dispensing of the web material to produce sheets of web material. Non-perforated web material may for instance be torn against an edge by a user during dispensing to produce sheets of web material.

WO 97/26818 discloses a braking arrangement for dispensers of continuous material in the form of perforated paper. The arrangement includes a first gearwheel arranged for rotation about a first axis and a second gearwheel arranged for rotation about a second axis. The second gearwheel is arranged for displacement relative to the first gearwheel such that the second axis remains parallel to the first axis. The second gearwheel is biased towards the first gearwheel to partially intermesh therewith. A variable gap is defined between the first and second gearwheel for passage of the continuous material. A biasing force acting on the second gear wheel may be set by means of a screw compressing or expanding a spring.

US 2005/067424 discloses a centre pull tissue dispenser for a coreless roll of towel material. Downstream of the roll there is provided a dispensing characteristic adjustment mechanism which includes a passageway through which the towel passes and a passageway restriction controlling member, movable relative to the passageway. The dispenser may be used with perforated or non-perforated towel material. A carrier carries a restriction controller and a restriction adjustment mechanism. The carrier is moveable between two conditions, the first at which the restriction controller is operative and the other at which the restriction controller is substantially removed from the passage way to thereby clear the passageway to allow for more convenient feeding of tissue material.

The restriction controller is mounted in a sliding arrangement to slide in and out of the passage. By rotating a spindle, a linear displacement of the restriction controller will occur. The spindle is actuated by a user of the device to set the degree of restriction that is desired and required for convenient dispensing of the tissue. Such setting may be required when the dispenser is replenished with tissue having different strength characteristics.

US 2003/071102 discloses a dispenser for dispensing flexible web material from a centre pull roll and capable of accommodating different types of web material in the form of sheets separated by lines of perforation. The dispenser comprises a housing, a web support within the housing and structure permitting the dispenser to self-adjust to the effective cross-sectional area of the web. The dispenser structure includes elements positioned to receive the web between them. At least one of the elements is movable and is biased for displacement toward the other. Frictional forces applied to the web by the elements resist a pull force applied to the web by a user so that a single web sheet separates from the web along the perforation when a user pulls on the web outside the housing.

There exists a need for dispensing units and dispensers which are able to be used for dispensing of perforated web material as well as non-perforated web material.

SUMMARY

An object of the present invention is to provide a dispensing unit for the use with continuous web material, which dispensing unit is able to be used in connection with dispensing of perforated web material as well as non-perforated web material.

According to an aspect of the invention, the object is achieved by a dispensing unit for a dispenser being adapted for use with continuous web material. The dispensing unit comprises a first roller arranged to rotate about a first axis and a second roller arranged to rotate about a second axis. The first and second axes are substantially parallel. A web path is provided through the dispensing unit and a portion of the web path consists of a web passage defined between the first roller and the second roller. The first roller is displaceable between at least a first position and a second position. A first distance is defined between the first roller and the second roller when the first roller is arranged in the first position and a second distance is defined between the first roller and the second roller when the first roller is arranged in the second position.

Since the first roller is displaceable between a first position and a second position with two different distances between the first and the second roller, perforated web may be dispensed through the dispensing unit when the first distance is set between the first and second rollers and non-perforated web may be dispensed when the second distance is set between the first and second rollers. The same dispensing unit may thus, be set for dispensing of perforated web as well as non-perforated web. As a result, the above mentioned object is achieved.

The dispensing unit may be integrated in a dispenser for continuous web material. In particular, various parts or portions of the dispensing unit may form part of the dispenser. Alternatively, the dispensing unit may form a separate unit, which is connected to a dispenser for continuous web material. The dispensing unit may be connected to a dispenser, e.g. at a lower end of a dispenser or at a front end of a dispenser. The dispenser may be suspended from a supporting structure, such as a wall, or it may form a free standing object.

According to embodiments, the dispensing unit may be adapted for dispensing of continuous web material when the first roller is in each of the first position and the second position. Such dispensing may relate to manual dispensing of continuous web material. The continuous web material may be either perforated or non/perforated.

According to embodiments, the first distance may be smaller than the second distance. In this manner the dispensing unit may be adapted for dispensing of perforated continuous web material when the first roller is arranged in the first position and the dispensing unit may be adapted for dispensing non-perforated continuous web material when the first roller is arranged in the second position. Accordingly, according to embodiments, the dispensing unit may be adapted for dispensing of perforated web material when the first roller is in the first position and for dispensing non-perforated web material when the first roller is in the second position.

In the first position of the first roller, the first and second rollers may both be positioned to abut against the continuous web material in the web passage during dispensing of portions of the continuous web material. At least when the first roller is in the first position, the first and second rollers may be rotated by the web material as it is being dispensed by a user from the dispenser. The web material thus frictionally engages with the first and second rollers. The frictional engagement between the web material and the first and second rollers ensures that the web material breaks at a perforation as a user pulls on the web material to dispense, and separate, a sheet of web material from the roll of continuous web material. In the second position of the first roller the web material is subjected to less or no frictional forces from the first and second rollers. In the first position of the first roller, portions of the first and second rollers may overlap to form an undulated web passage. In the second position of the first roller, the first and second rollers may be positioned such that only one of the first and second rollers abuts against the continuous web material in the web passage during dispensing of portions of the continuous web material.

According to embodiments, the first position may be a fixed position and the second position may be a fixed position. Accordingly, the first roller is fixed when positioned in the first position as well as when positioned in the second position.

According to embodiments, the first roller may be suspended in a first cradle. The first cradle may be movably arranged in the dispensing unit for selectively positioning the first roller in the first position and in the second position. In this manner the first roller may be positioned in one of the first and second positions by moving the first cradle into a corresponding position. The first cradle is suspended in the dispensing unit, e.g. in a wall portion of the dispensing unit.

According to embodiments, the dispensing unit may comprise a position controller being movable between a first setting and a second setting. One of the first cradle and the position controller may comprise a first cam surface and one of the first cradle and the position controller may comprise a first cam follower arranged to abut against and follow the first cam surface to displace the first cradle. The first cradle may be positioned such that the first roller is in the first position when the position controller is in the first setting and the first cradle may be positioned such that the first roller is in the second position when the position controller is in the second setting. In this manner the first cradle may be easily positioned to position the first roller in one of its first and second positions.

According to embodiments, the dispensing unit may comprise a first visual indicator at an outer surface of the dispensing unit. The position controller may be arranged to interact with the first visual indicator to indicate the first position and the second position, respectively. In this manner it may be clearly visible to a user, who replenishes a relevant dispenser, which of the first and second positions the first roller is positioned in. The first visual indicator may comprise a protrusion or a depression, e.g. in the shape of a digit or a letter. If a corresponding digit or letter is provided with the web material which is to replenish the relevant dispenser, the user may easily select the correct setting for the position controller.

According to embodiments, the dispensing unit may comprise a tear-off arrangement for web material arranged downstream of the web passage, seen in a dispensing direction. In this manner a user may separate a portion of non-perforated web material from the continuous web material in a relevant dispenser by means of the tear-off arrangement.

According to embodiments, the first roller may be arranged to guide the web path clear of the tear-off arrangement in the first position and the first roller may be arranged to exposes the web path to the tear-off arrangement in the second position. In this manner a user may be able to use the tear-off arrangement for non-perforated web material whereas, perforated web material is not severed by the tear-off arrangement.

According to embodiments, the second roller may be suspended in a second cradle being movably arranged in the dispensing unit. In this manner further possibilities for adjustment of dispensing characteristics of the dispensing unit may be provided. For example, the characteristics for dispensing perforated web material, when the first roller is in the first position may be changed. The second cradle is suspended in the dispensing unit, e.g. in a wall portion of the dispensing unit.

According to embodiments, the dispensing unit may comprise a resilient element. The second cradle may be biased in a direction towards the first roller by the resilient element. In this manner the second roller may be movable in relation to the first roller during dispensing of web material and always be returned to an initial position by the resilient element. During dispensing, the distance between the first and second rollers, i.e. a depth of the web passage, may be adapted to a thickness of the web material passing through the web passage.

According to embodiments, the dispensing unit may comprise a setting controller movable between a third setting and a fourth setting. One of the second cradle and the setting controller may comprise a second cam surface and one of the second cradle and the setting controller may comprise a second cam follower arranged to abut against and follow the second cam surface to displace the second cradle. The second cradle may be positioned such that the second roller is in a third position when the setting controller is in the third setting and the second cradle is positioned such that the second roller is in a fourth position when the setting controller is in the fourth setting. In this manner a distance between the first and second rollers may be further adjusted, e.g. when the first roller is in the first position.

According to embodiments, the second cradle may be movable in a direction away from the first roller against a biasing force of the resilient element. Thus, a minimum distance between the first roller and the second roller may be defined by the second cam surface and the second cam follower. The distance between the first and second rollers may be increased from the respective minimum distance thanks to the movability of the second cradle. The second roller is thus movable in a direction away from the third and fourth positions.

The mentioned positions of the second roller and distances between the first and second rollers are herein defined in a static state when no dispensing takes place, i.e. at least the second roller may be movable during dispensing of web material due to the second cradle being biased towards the first roller by the resilient element. That is, when the second cradle is positioned such that the second roll is in the third position, the second roller may be displaced towards, or past, the fourth position together with the second cradle, against the biasing force of the resilient element, during dispensing of web material.

According to embodiments, the dispensing unit may comprise a second visual indicator at an outer surface of the dispensing unit. The setting controller may be arranged to interact with the second visual indicator to indicate the third position and the fourth position, respectively. In this manner it may be clearly visible to a user, who replenishes a relevant dispenser, which of the third and fourth positions the second roller is positioned in. The second visual indicator may comprise a protrusion or a depression, e.g. in the shape of a digit or a letter. If a corresponding digit, letter, or other marking is provided with the web material which is to replenish the relevant dispenser, the user may easily select the correct setting for the setting controller.

According to embodiments, the resilient element may be suspended in a third cradle being movably arranged in the dispensing unit. The third cradle may be arranged to be positioned in at least a fifth position and a sixth position, the fifth position being closer to the second cradle than the sixth position. In this manner the second cradle may be subjected to different biasing forces depending on, in which of the fifth and sixth positions the third cradle is positioned. The third cradle is suspended in the dispensing unit, e.g. in a wall portion of the dispensing unit.

According to embodiments, the first roller and the second roller may comprise disc-shaped elements arranged at a distance from each other along the first and second axes. When the first roller is in the first position, the disc-shaped elements of the first roller may overlap the disc-shaped elements of the second roller to form an undulated web passage between the first and second rollers. In this manner it may be ensured that perforated web material thoroughly engages with the first and second rollers. The first and second rollers define between themselves a web passage forming a nip, in which frictional forces between the first and second rollers on the one hand and the web material on the other hand allow a user to separate a sheet of web material along its perforation from a roll of continuous web material.

Put differently, the disc-shaped elements form large diameter longitudinal sections of the first and second rollers, between which small diameter sections are arranged. The first roller and the second roller may be arranged such that a small diameter longitudinal section of the first roller is opposite to a large diameter longitudinal section of the second roller and a large diameter longitudinal section of the first roller may be opposite to a small diameter longitudinal section of the second roller, when the first roller is in the first position. The first roller and the second roller may be arranged at a distance from each other such that the web passage defined between the first and second rollers is undulated.

According to embodiments, at least one of the disc-shaped elements, seen in a circumferential direction, may comprise narrow portions and wide portions. In this manner the at least one disc-shaped element may form a cog wheel having axial cogs which may further improve a frictional engagement between the first and second rollers and the web material during dispensing. Furthermore, at least one disc-shaped element of each of the first and second roller may comprise narrow and wide portions. In this manner the axial cogs of the disc-shaped elements of each roller may form part of the web passage.

According to embodiments, the continuous web material has a first width and the web passage has a second width in a direction parallel with the first axis. The second width may be smaller than the first width. In this manner the continuous web material may be folded up or wrinkled along more and less sharp creases running in a main direction along the web material, i.e. substantially perpendicularly to the first width. The web material may thus frictionally engage with the first and second rollers, at least when the first roller is in the first position. When dispensing web material from a centre feed roll of continuous web material, the web material is dispensed from the centre of such a roll in the above-mentioned folded up or wrinkled state. When dispensing from a peripheral feed roll of continuous web material the web material may be folded up or wrinkled, as mentioned above, upon entering the web passage.

According to a further aspect, the above-mentioned object is achieved by a dispenser comprising a housing adapted to receive a roll of continuous web material, wherein the housing has a dispensing end. The dispenser comprises a dispensing unit according to any one of above-mentioned aspects and/or embodiments arranged at the dispensing end. The web path extends from the dispensing end to, and through, the dispensing unit.

According to embodiments, the housing may be adapted to receive a centre feed roll of continuous web material.

Further features of, and advantages with, the present invention will become apparent when studying the appended claims and the following detailed description. Those skilled in the art will realize that different features of the present invention may be combined to create embodiments other than those described in the following, without departing from the scope of the present invention, as defined by the appended claims.

BRIEF DESCRIPTION OF THE DRAWINGS

The various aspects of the invention, including its particular features and advantages, will be readily understood from the following detailed description and the accompanying drawings, in which.

DETAILED DESCRIPTION

The present invention will now be described more fully with reference to the accompanying drawings, in which example embodiments are shown. However, this invention should not be construed as limited to the embodiments set forth herein. Disclosed features of example embodiments may be combined as readily understood by one of ordinary skill in the art to which this invention belongs. Like numbers refer to like elements throughout. Well-known functions or constructions will not necessarily be described in detail for brevity and/or clarity.

Figure 1:
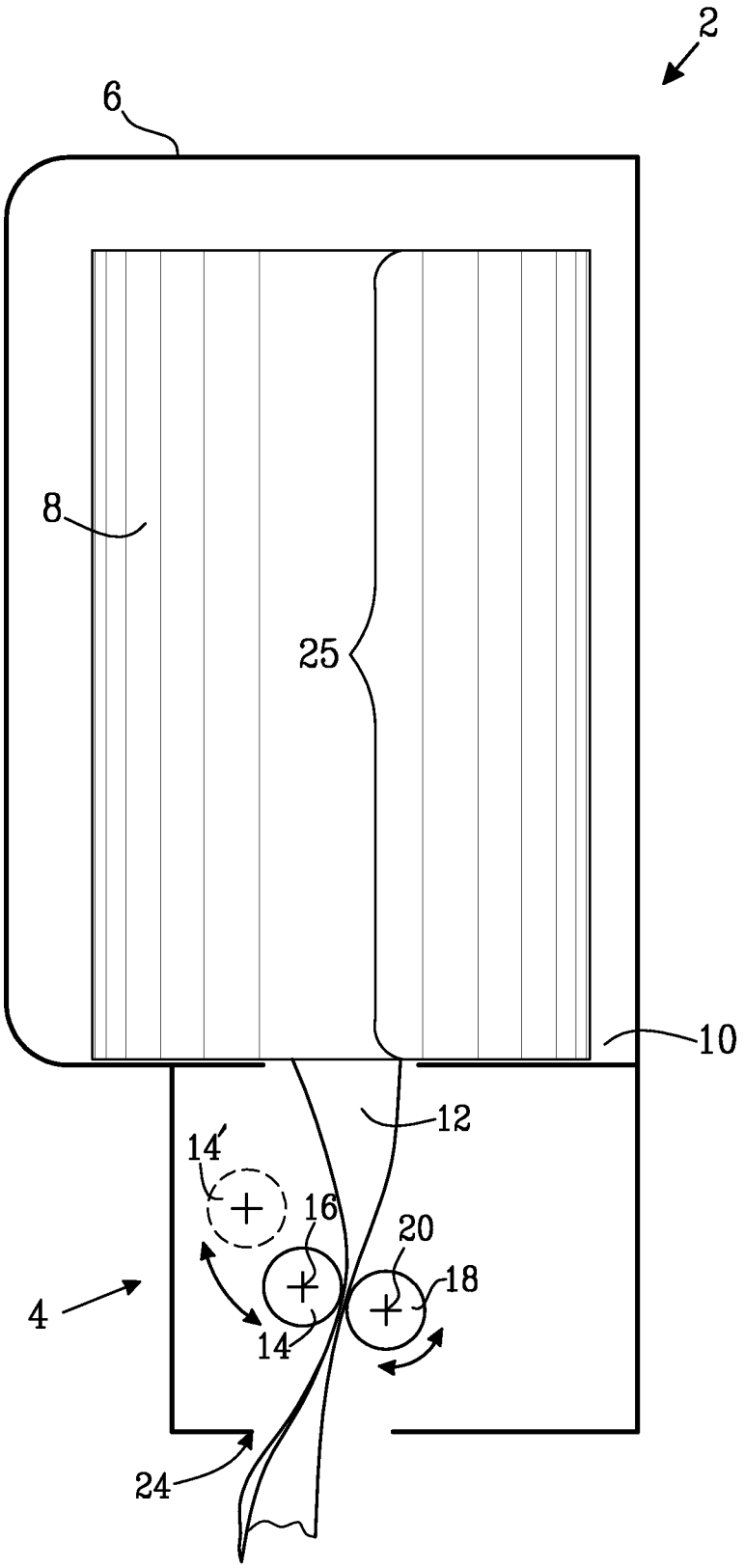
FIG. 1 illustrates schematically a cross section through a dispenser and a dispensing unit according to embodiments.

FIG. 1 illustrates schematically a cross section through a dispenser 2 and a dispensing unit 4 according to embodiments. The dispenser 2 comprises a housing 6 adapted to receive a roll 8 of continuous web material. The housing 6 may be opened for replenishing the dispenser 2 with rolls of continuous web material. The housing 6 has a dispensing end 10. In its broadest interpretation the dispensing end 10 is simply a portion of the housing 6, where a tail 12 of the continuous web material parts from the roll 8. The dispenser 2 comprises the dispensing unit 4, which is arranged at the dispensing end 10 of the housing 6. This encompasses the dispensing unit 4 forming an integral part of the dispenser 2 as well as the dispensing unit 4 forming a separate part of the dispenser 2. Such a separate part may be either permanently or removably attached to the housing 6 of the dispenser 2. The dispensing unit 4 is provided for separating a sheet of web material from the tail 12 of continuous web material. The housing 6 is adapted to receive a centre feed roll 8 of continuous web material. However, the dispensing unit 4 may also be used in connection with peripheral feed rolls of continuous web material, in which case the housing of the dispenser is adapted to receive such a roll of continuous web material and to provide a dispensing end at the dispensing unit 4.

The dispensing unit 4 comprises a first roller 14 arranged to rotate about a first axis 16 and a second roller 18 arranged to rotate about a second axis 20. The first and second axes 16, 20 are substantially parallel. A web path is provided through the dispensing unit 4 and a portion of the web path consists of a web passage defined between the first roller 14 and the second roller 18. The tail 12 of the continuous web material extends along the web path in FIG. 1. The first roller 14 is displaceable, as illustrated by arrow 22, between at least a first position in which the first roller 14 is illustrated with a continuous line, and a second position in which the first roller 14' is illustrated with a broken line. A first distance is defined between the first roller 14 and the second roller 18 when the first roller 14 is arranged in the first position, and a second distance is defined between the first roller 14 and the second roller 18 when the first roller 14 is arranged in the second position. The first position is a fixed position and the second position is a fixed position. The web path extends from the dispensing end 10 of the housing 6 and through the dispensing unit 4.

The dispenser 2 and the dispensing unit 4 are adapted for dispensing of continuous web material when the first roller 14 is in each of the first position and in the second position. The first distance is smaller than the second distance. Thus, dispensing of perforated continuous web material may suitably be performed when the first roller 14 is in the first position. When the first roller 14 is in the first position, the web passage has a width forming a nip. When a user pulls on the tail 12, frictional forces applied to the web material by the first and second rollers 14 will cause a relevant perforation to break. Dispensing of non-perforated continuous web material may suitably be performed when the first roller 14 is in the second position. For the latter, the dispensing unit 4 comprises a tear-off arrangement 24 arranged downstream of the web passage. The tear-off arrangement 24 comprises e.g. a serrated edge. A user thus, may separate a sheet of non-perforated web material from the continuous web material by means of pulling the web material against the tear-off arrangement 24.

The first roller 14 is arranged to guide the web path clear of the tear-off arrangement 24 in the first position (continuous line). In the second position (broken line), the first roller 14' is arranged to exposes the web path to the tear-off arrangement 24. In this manner a user may be able to use the tear-off arrangement 24 for non-perforated web material whereas perforated web material is held clear of the tear-off arrangement 24.

The continuous web material has a first width 25, which corresponds to the width of the roll 8. The web passage has a second width in a direction parallel with the first axis 16. The second width is smaller than the first width.

Figure 2:
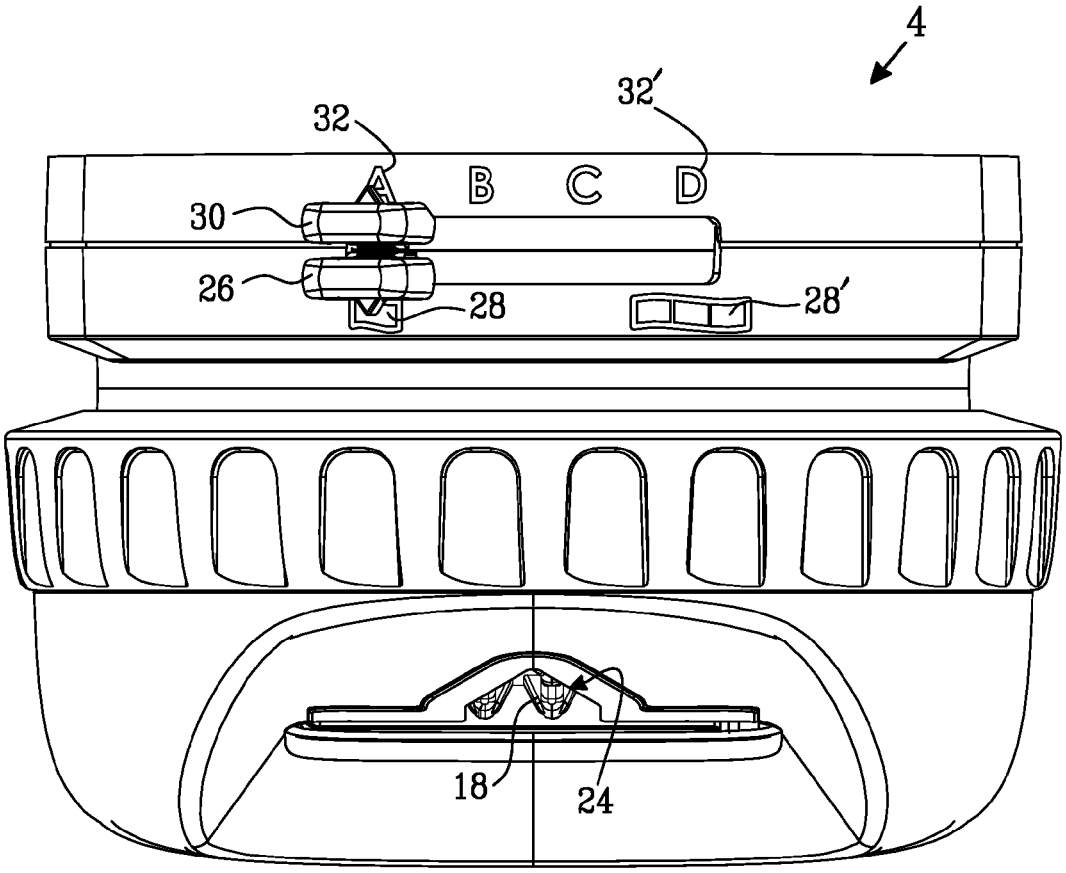
FIG. 2 illustrates a dispensing unit adapted for dispensing continuous web material according to embodiments.

FIG. 2 illustrates a dispensing unit 4 adapted for dispensing of continuous web material according to embodiments. The dispensing unit 4 comprises a first roller (not visible) and a second roller 18. A web path for the continuous web material extends through the dispensing unit 4 and a portion of the web path consists of a web passage defined between the first roller and the second roller 18. The first roller is displaceable between at least a first position and a second position. In the second position the first roller is at a greater distance from the second roller 18 than in the first position. The dispensing unit 4 comprises a tear-off arrangement 24 having a V-shaped opening. The first roller is arranged to guide the web path clear of the tear-off arrangement 24 in the first position. In the second position, the first roller is arranged in the dispensing unit 4 such that the web path is exposed to the tear-off arrangement 24.

In FIG. 2 the dispensing unit 4 is illustrated with the first roller arranged in the second position. Thus, the dispensing unit 4 is set for dispensing of non-perforated continuous web material. A user pulling the web material into the pointed portion of the V-shaped opening of the tear-off arrangement 24 thus, may separate a sheet of non-perforated web material from the continuous web material.

The dispensing unit 4 comprises a position controller 26 being movable between a first setting and a second setting. By means of the position controller 26 the first roller is positioned in one of the first and second positions. The dispensing unit 4 comprises a first visual indicator 28, 28' at an outer surface of the dispensing unit. The position controller 26 is arranged to interact with the first visual indicator 28, 28' to indicate the first position and the second position, respectively. In FIG. 2, the first visual indicator 28, 28' shows a non-perforated web material 28 and a perforated web material 28'. Accordingly, the position controller 26 is illustrated in the second setting, in which the first roller is in the second position and the dispensing unit 4 is set for dispensing of non-perforated web material.

The dispensing unit 4 further comprises a setting controller 30 movable between at least two settings, in the following called a third setting and a fourth setting. By means of the setting controller 30 the second roller 18 is positioned in one of at least two positions, herein called a third position and a fourth position. More particularly, the setting controller 30 illustrated in FIG. 2 is movable between four settings and thus, there are provided four positions for the second roller 18.

The dispensing unit 4 comprises a second visual indicator 32, 32' at an outer surface of the dispensing unit. The setting controller 30 is arranged to interact with the second visual indicator 32, 32' to indicate the third position and the fourth position of the second roller 18, respectively, as well as the two further positions. The second visual indicator 32, 32' shows different letters, one for each setting of the setting controller 30 and corresponding positions of the second roller 18.

Figure 3A:
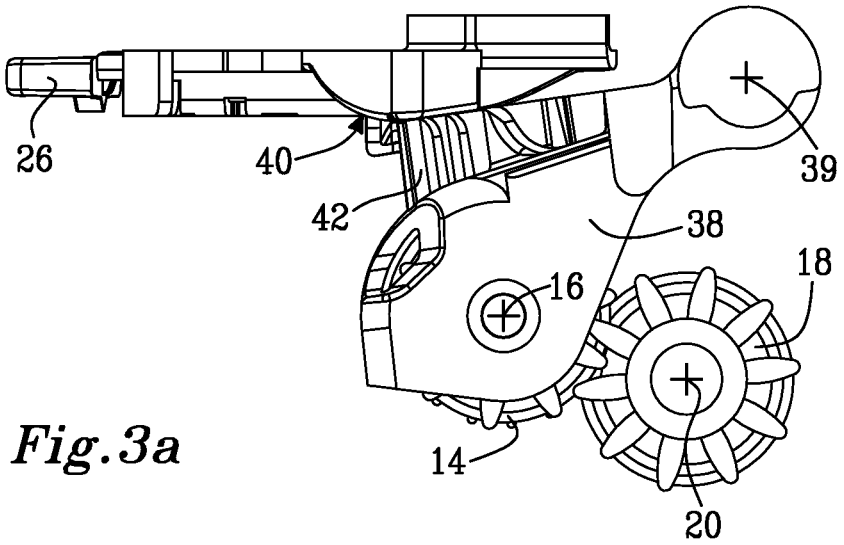
FIGS. 3*a*, 3*b*, 4*a*, 4*b*, 5*a*, 5*b*, 6*a*, and 6*b* illustrate a side view of first and second rollers and a position controller of the dispensing unit illustrated in FIG. 2, FIGS. 7*a* and 7*b* illustrate first and second rollers of a dispensing unit according to embodiments.
Figure 3B:
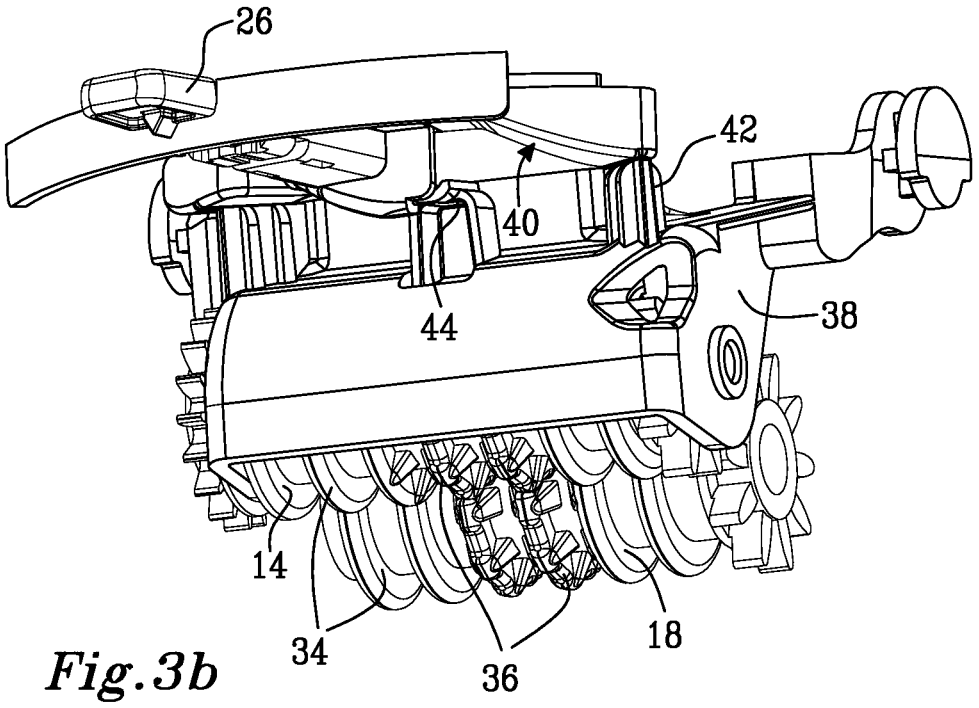

FIGS. 3*a* and 3*b* illustrate a side view of the first and second rollers 14, 18 and the position controller 26 of the dispensing unit 4 illustrated in FIG. 2. The first roller 14 is positioned in its first position. The first and second rollers 14, 18 comprise disc-shaped elements 34, 36. In the first position of the first roller 14, the disc-shaped elements 34, 36 of the first and second rollers 14, 18 overlap, seen along a first axis 16 of the first roller and a second axis 20 of the second roller 18. The first roller 14 is rotatably suspended in a first cradle 38. The first cradle 38 is movably arranged in the dispensing unit 4. More particularly, in these embodiments the first cradle 38 is pivotable about a first cradle axis 39. The first roller 14 may be positioned in one of the first and second positions by moving the first cradle 38 into a corresponding position. The position controller 26 interacts with the first cradle 38. In the first setting of the position controller 26 the first cradle 38 is set such that the first roller 14 is in the first position and vice versa, i.e. in the second setting of the position controller 26 the first cradle 38 is set such that the first roller 14 is in the second position. The position controller 26 comprises a first cam surface 40 and the first cradle 38 comprises a first cam follower 42 arranged to abut against and follow the first cam surface 40 to displace the first cradle 38. A user may thus, by operating the position controller 26, position the first roller in either of its first and second positions.

The position controller 26 comprises a further cam surface (not visible) facing in an direction opposite to the first cam surface 40 and the first cradle 38 has a further cam follower 44 arranged to abut against the further cam surface. Thus, the first cradle 38 is fixed by the first cam surface 40 and the first cam follower 42 in one direction, and by the further cam surface and the further cam follower 44, in the opposite direction. Accordingly, the first position of the first roller 14 is a fixed position and the second position of the first roller 14 is a fixed position.

Figure 4A:
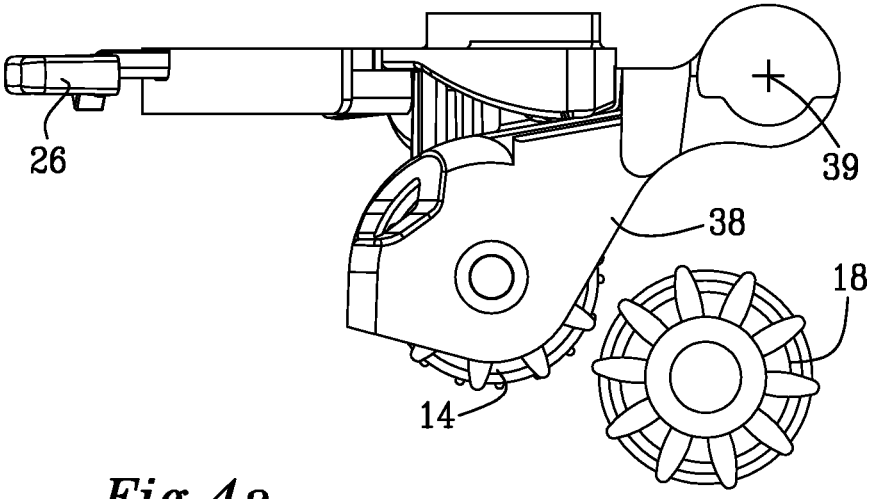
Figure 4B:
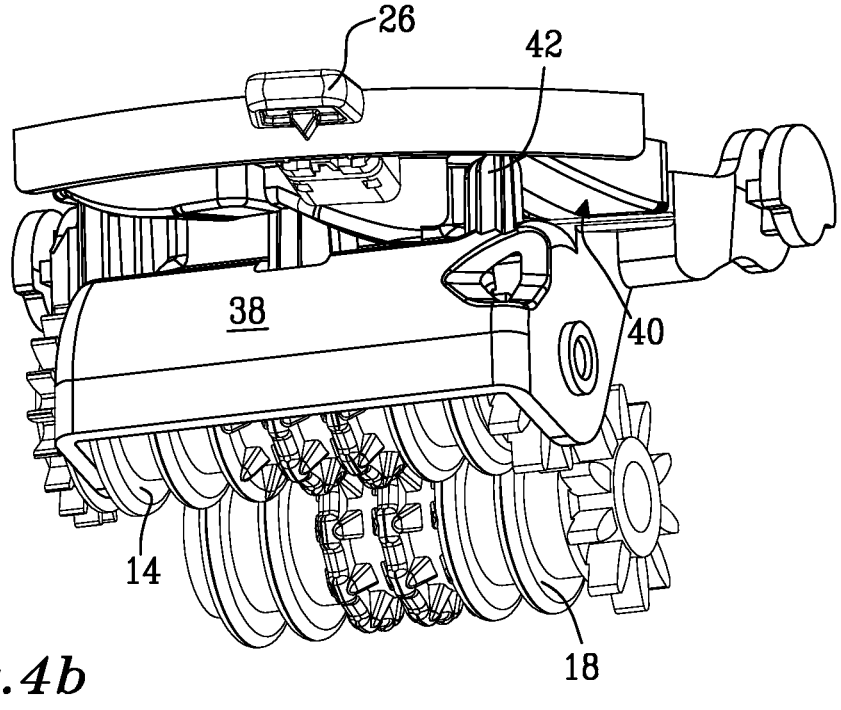

FIGS. 4*a* and 4*b* illustrate the first and second rollers 14, 18 and the position controller 26 of FIGS. 3*a* and 3*b* with the first roller 14 positioned in its second position. The position controller 26 is positioned in its second setting, in which the first cam follower 42 abuts against the first cam surface 40 in a position farther away from the second roller 18 than when the first roller 14 is in the first position. Thus, the first cradle 38 is pivoted about the first cradle axis 39 in a direction away from the second roller 18 in comparison with the position illustrated in FIGS. 3*a* and 3*b*.

Figure 5A:
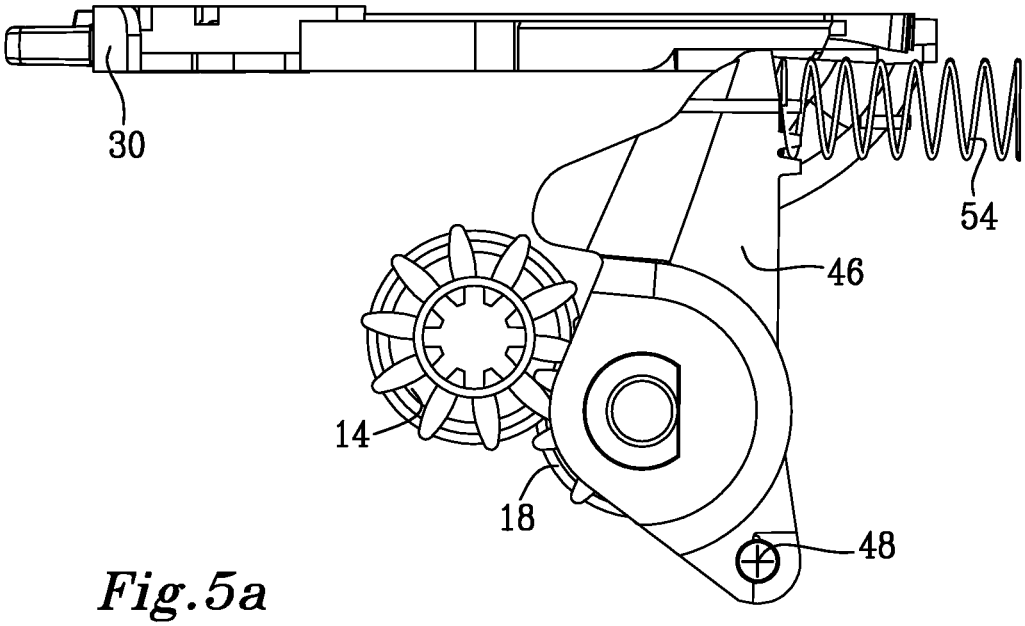
Figure 5B:
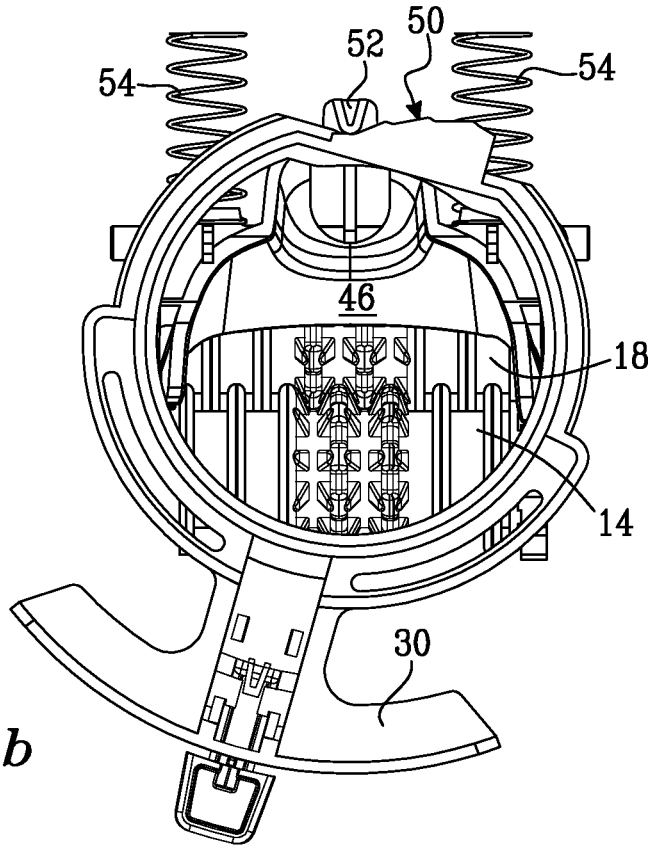

FIGS. 5*a* and 5*b* illustrate a side view of the first and second rollers 14, 18 and the setting controller 30 of the dispensing unit 4 illustrated in FIG. 2. The first roller 14 is positioned in its first position. The second roller 18 is rotatably suspended in a second cradle 46, which is movably arranged in the dispensing unit. By means of the setting controller 30, which interacts with the second cradle 46, the second cradle 30 may be moved by pivoting about a second cradle axis 48. The setting controller 30 is movable between at least the third setting and the fourth setting. The setting controller 30 comprises a second cam surface 50 and the second cradle 46 comprises a second cam follower 52 arranged to abut against and follow the second cam surface 50 to displace the second cradle 46. In FIGS. 5*a* and 5*b*, the setting controller 30 is illustrated in the third setting, which corresponds to the second cradle 46 being positioned such that the second roller 18 is in the third position.

Due to the movability of the second cradle 46, dispensing characteristics of the dispensing unit may be adjusted. In particular, when the first roller 14 is in the first position, characteristics for dispensing perforated web material may be changed. Each setting of the setting controller 30 corresponds to a different position of the second roller 18. The distance between the first and second rollers 14, 18 may thus be adjusted in small increments to adapt the dispensing unit and a relevant dispenser to a particular kind of perforated continuous web material. The distance is suitably set such that the perforations of a relevant continuous web material rupture downstream of the first and second roller 14, 18, seen in a dispensing direction of the web material. A general guideline is that, for web material with strong perforations, the distance between the first and second rollers 14, 18 is set smaller than for a web material with weak perforations.

The dispensing unit comprises a resilient element 54 which, in the illustrated embodiments, comprises two coils springs. The resilient element 54 abuts against a not shown portion of the dispensing unit and biases the second cradle 46 in a direction towards the first roller 14. During dispensing of web material, the distance between the first and second rollers 14, 18, i.e. a depth of the web passage, is adapted to a thickness of the web material passing through the web passage. Accordingly, the second cradle 46 is movable in a direction away from the first roller 14 against a biasing force of the resilient element 54 in the respective third and fourth positions. Purely mentioned as an example, the resilient element 54 may provide a force of approximately 15 N, which may result in a biasing force of the second roller 18 of approximately 35 N. That is, in this case, if the continuous web material would subject the second roller 18 to a force larger than 35 N, the second cradle 46 would be moved in a direction away from the first roller 14 compressing the resilient element 54.

Figure 6A:
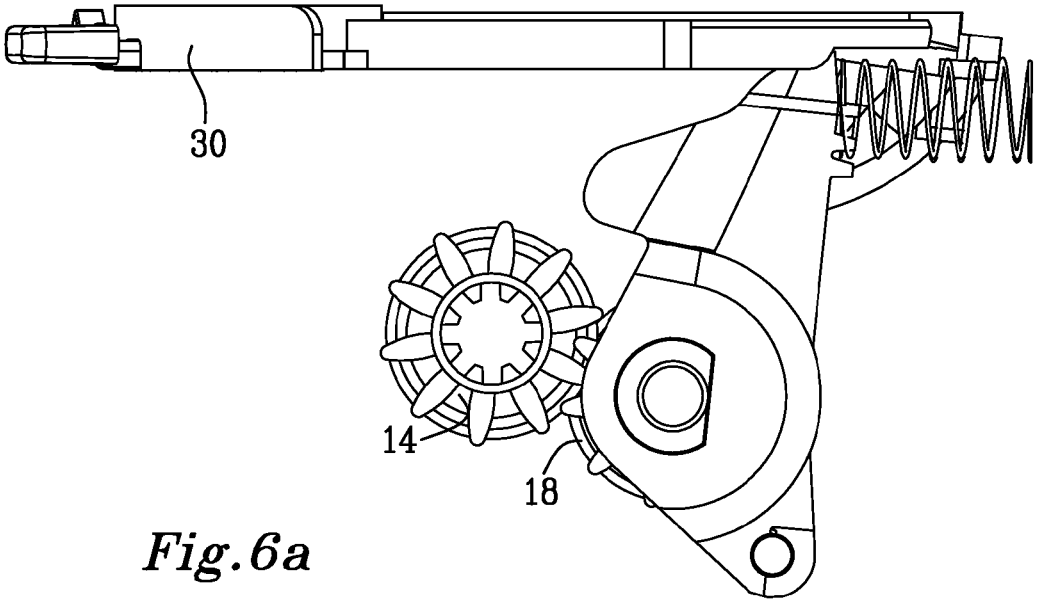
Figure 6B:
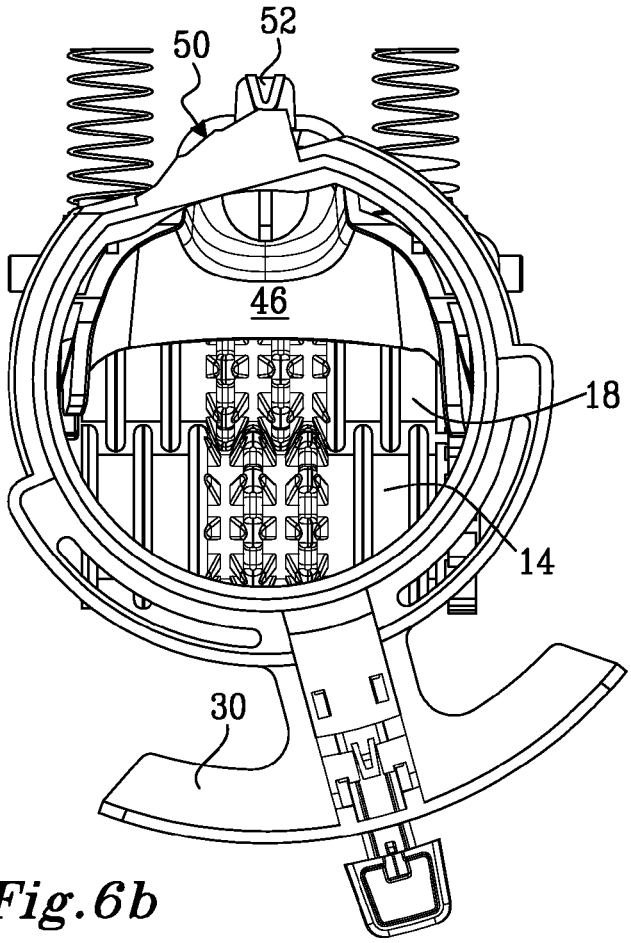

FIGS. 6*a* and 6*b* illustrate the first and second rollers 14, 18 and the setting controller 30 of FIGS. 5*a* and 5*b* with the second roller 18 positioned in its fourth position. The setting controller 30 is in the fourth setting and the second cradle 46 is positioned such that the second roller 18 is in the fourth position. As may be seen in FIG. 6*b*, the second cam follower 52 abuts against the second cam surface 50 at a level farther away from the first roller 14 than the second cam follower 52 abuts against the second cam surface 50 in FIG. 5*b*. Accordingly, the second roller 18, in its fourth position, is positioned farther away from the first roller than in its third position. The second cam surface 50 has two further levels in between the two levels corresponding to the third and fourth settings of the setting controller 30.

The first roller 14 is positioned in its first position in FIGS. 5*a* and 5*b* as well as in FIGS. 6*a* and 6*b*. It is to be noted that the disc-shaped elements of the first and second rollers 14, 18 overlap each other when the first roller 14 is in the first position, irrespective of whether the second roller 18 is in the third position or the fourth position.

Figure 7A:
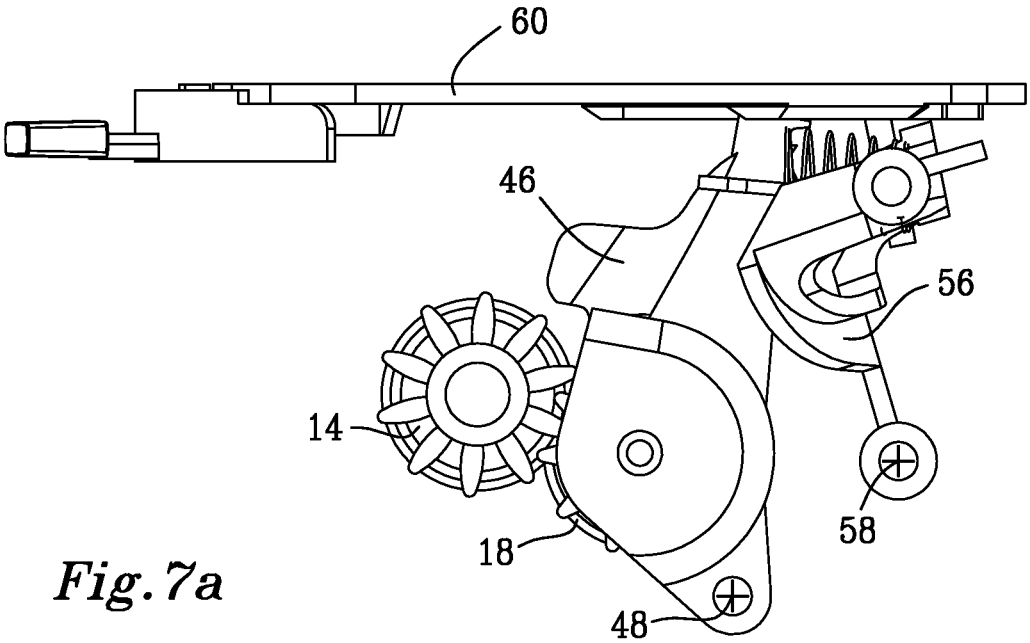
Figure 7B:
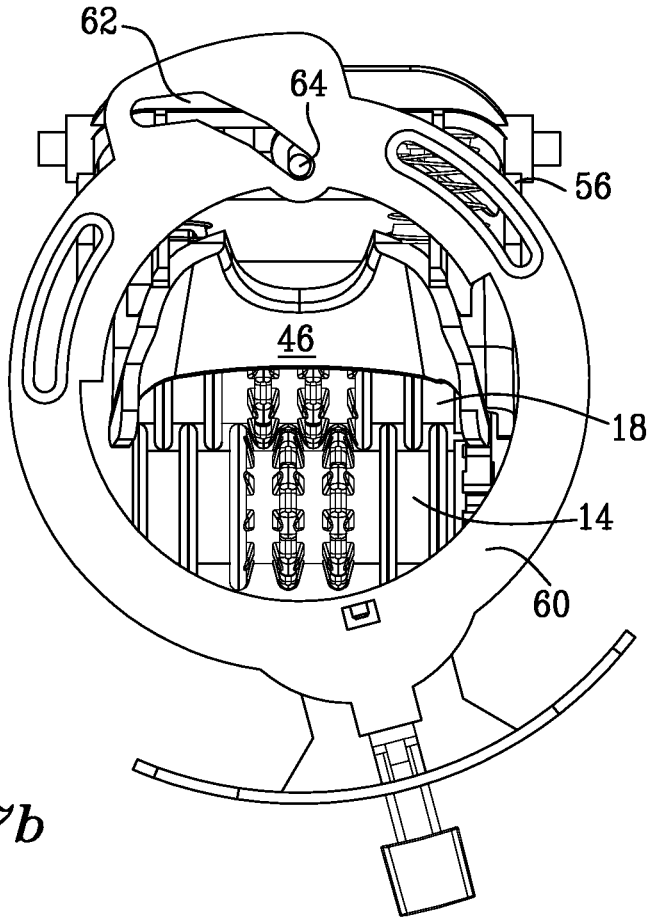

FIGS. 7*a* and 7*b* illustrate first and second rollers 14, 18 of a dispensing unit according to embodiments. Again, the first and second rollers 14, 18 are movably arranged in a first cradle (not shown) and a second cradle 46. The first cradle may be set to position the first roller 14 in a first position and a second position. The dispensing unit comprises a resilient element 54. The resilient element 54 is suspended in a third cradle 56 and abuts against the second cradle 46. The third cradle 56 is movably arranged in the dispensing unit. More particularly, the third cradle 56 is pivotable about a third cradle axis 58. The third cradle 56 is arranged to be positioned in at least a fifth position and a sixth position, the fifth position being closer to the second cradle 46 than the sixth position. In this manner the second cradle 46 may be subjected to different biasing forces depending on in which of the fifth and sixth positions the third cradle 56 is positioned. Accordingly, a resistance with which the second cradle may pivot about a second pivot axis 48 may be set. Thus, a frictional force applied from the first and second rollers 14, 18 to a web material passing through a web passage between the first and second rollers 14, 18 may be adjusted.

The fifth and sixth positions of the third cradle 56 are set by means of a positioning device 60. The positioning device 60 comprises a slot 62 along which a pin 64 of the third cradle 56 is guided. By moving the positioning device 60, the pin 64 is displaced along the slot 62 and thus, the third cradle 56 is moved between the fifth and sixth positions.

Figure 8A:
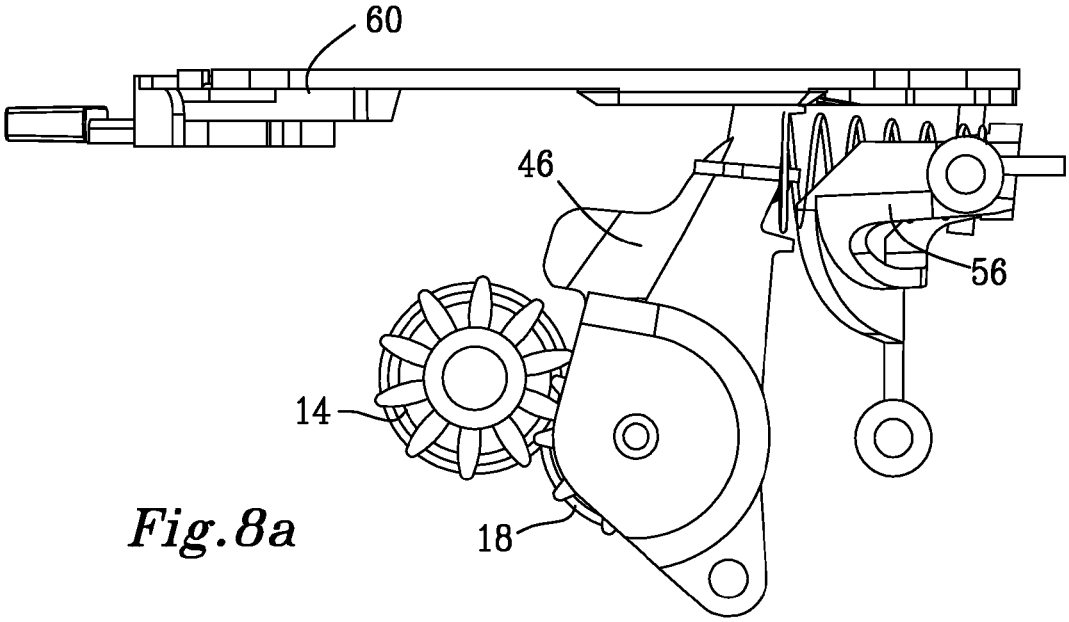
FIGS. 8*a* and 8*b* illustrate parts of the dispensing unit of FIGS. 7*a* and 7*b*.
Figure 8B:
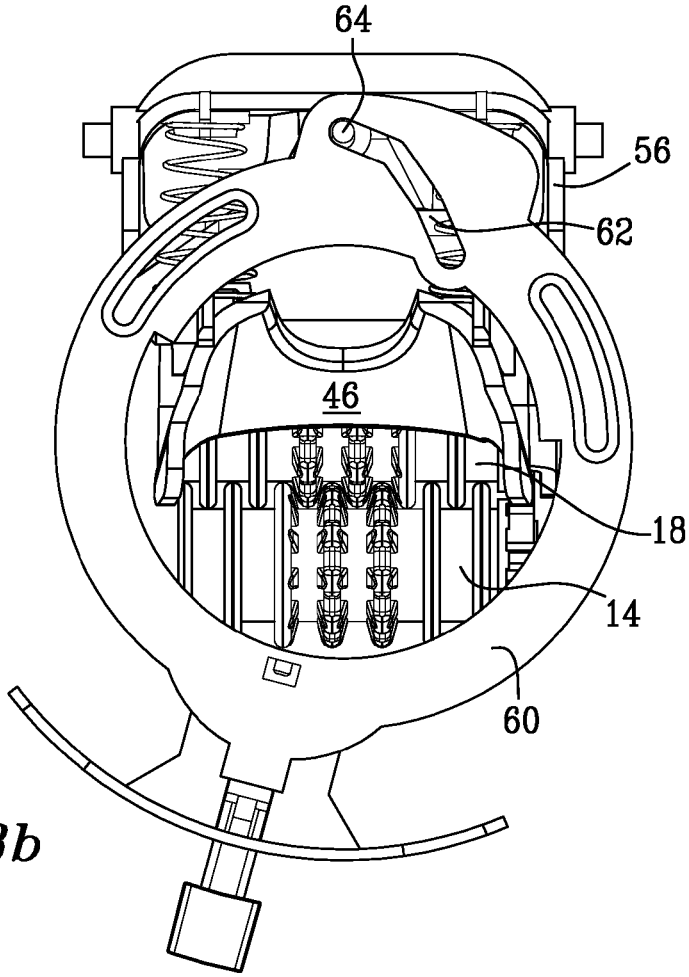

FIGS. 8*a* and 8*b* illustrate parts of the dispensing unit of FIGS. 7*a* and 7*b* with the third cradle arranged in the sixth position. The positioning device 60 is positioned such that the pin 64 is at an opposite end of the slot 62 compared to the position of the positioning device 60 as illustrated in FIGS. 7*a* and 7*b*. Thus, the second cradle 46 and the second roller 18 are biased with a lesser force towards the first roller 14, than in FIGS. 7*a* and 7*b*.

Figure 9:
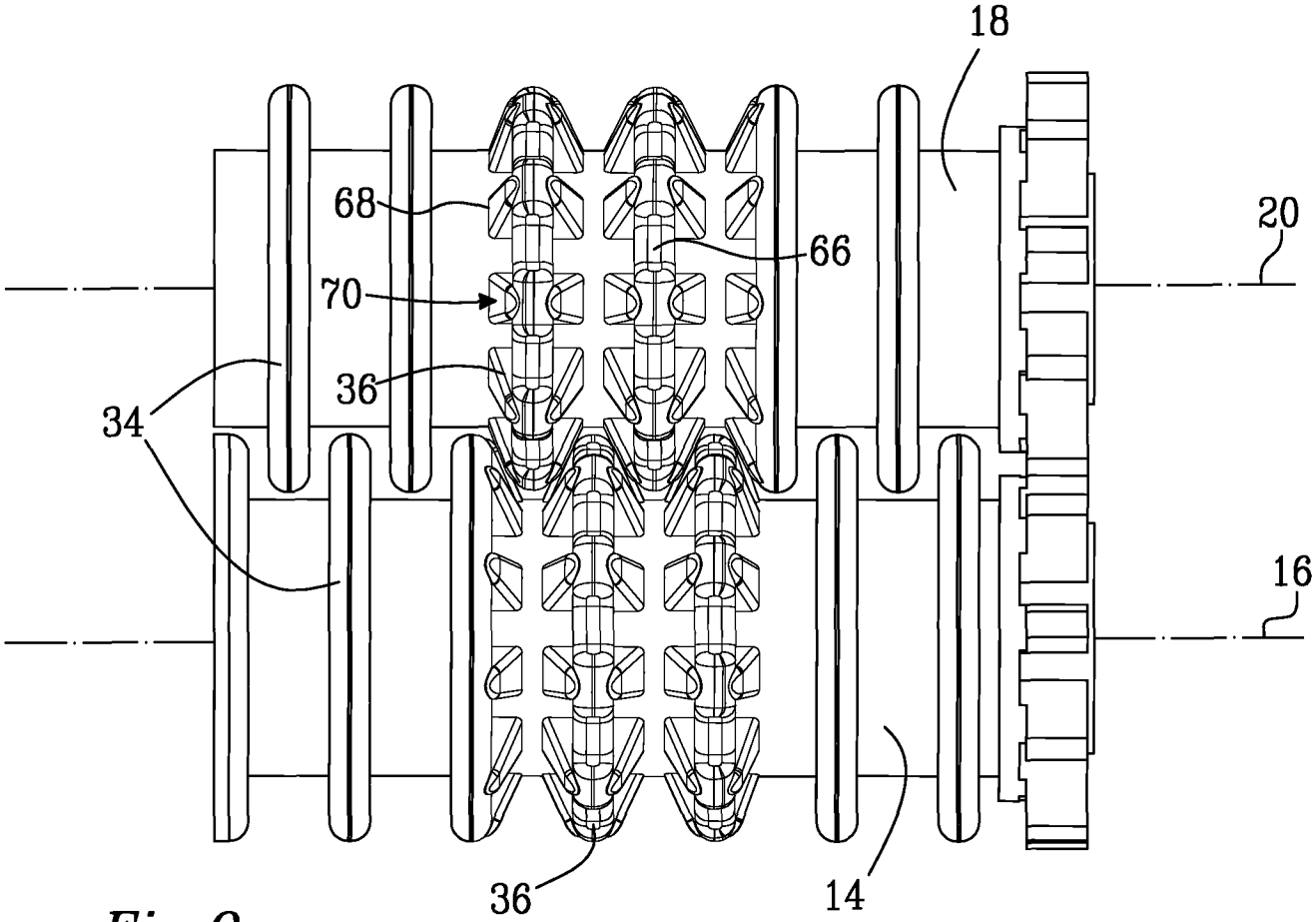
FIG. 9 illustrates first and second rollers of a dispensing unit according to embodiments.

FIG. 9 illustrates first and second rollers 14, 18 of a dispensing unit according to embodiments. The first roller 14 and the second roller 18 comprise disc-shaped elements 34, 36 arranged at a distance from each other along first and second axes 16, 20 of the first and second rollers 14, 18, respectively. The first roller 14 is arranged in a first position, in which the disc-shaped elements 34, 36 of the first roller 14 overlap the disc-shaped elements 34, 36 of the second roller 18 and form an undulated web passage between the first and second rollers 14, 18. Accordingly, the disc-shaped elements 34, 36 form large diameter longitudinal sections of the first and second rollers 14, 18 between which small diameter sections are arranged. Small diameter longitudinal sections of the respective rollers 14, 18 are arranged opposite to large diameter longitudinal section. At least one of the disc-shaped elements 36 of each roller, seen in a circumferential direction, comprises narrow portions 66 and wide portions 68. In this manner the at least one disc-shaped element 36 of each roller 14, 18 forms a cog wheel having axial cogs 70. The axial cogs 70 of the disc-shaped elements 36 of the rollers 14, 18 form a part of the web passage.

According to embodiments, the disc-shaped elements 34, 36 of the first roller 14 and the second roller 18 may overlap each other 1.5-6 mm in the first position of the first roller 14. The overlap is seen in a direction along the first and second axes 16, 20. Provided purely as an example, the overlap between the disc-shaped elements 34, 36 of the first and second rollers 14, 18 may be 3.5 mm when the second roller 18 in its third position as illustrated in FIGS. 5*a* and 5*b*, and the overlap may be 2.2 mm when the second roller 18 in its fourth position as illustrated in FIGS. 6*a* and 6*b*. It is to be understood that there is a clearance between the disc-shaped elements 34, 36 of the first roller 14 and the second roller 18, and between the disc-shaped elements 34, 36 of the second roller 18 and the first roller 14. The clearance may be within the same range as the overlap. Purely as an example the following measurements may be mentioned, the diameters of the rollers 14, 18 may be 20 mm or may be within the interval of 12-40 mm. The diameters of the disc-shaped elements 34, 36 may be 30 mm or may be within the interval of 20-50 mm. The width of the disc-shaped elements 34, 36 may be 3 mm or within the interval of 2-5 mm. The cogs 70 may be approximately 4 mm wide, or within the interval of 2-5 mm, at their bases in the circumferential direction. The distance between the cogs 70 may be approximately 5 mm, or within the interval of 3-7 mm, at their bases in the circumferential direction. The cogs 70 may be approximately 6 mm wide, or within the interval of 4-8 mm, at their bases in the axial direction. The width of the undulated web passage between the disc-shaped elements 34 may be 1.4 mm or within the interval of 0.5-5 mm.

Example embodiments described above may be combined as understood by a person skilled in the art. Although the invention has been described with reference to example embodiments, many different alterations, modifications and the like will become apparent for those skilled in the art. For example a cam surface may form part of a slot or a track. The cradles may be slidably arranged in the dispensing unit instead of being pivotable. Therefore, it is to be understood that the foregoing is illustrative of various example embodiments and the invention is not to be limited to the specific embodiments disclosed and that modifications to the disclosed embodiments, combinations of features of disclosed embodiments as well as other embodiments are intended to be included within the scope of the appended claims.

As used herein, the term "comprising" or "comprises" is open-ended, and includes one or more stated features, elements, steps, components or functions but does not preclude the presence or addition of one or more other features, elements, steps, components, functions or groups thereof.

The invention claimed is:

1. A dispensing unit for a dispenser being adapted for use with continuous web material, the dispensing unit comprising a first roller arranged to rotate about a first axis and a second roller arranged to rotate about a second axis, the first and second axes being substantially parallel, wherein a web path is provided through the dispensing unit and a portion of the web path comprises a web passage defined between the first roller and the second roller and through which the web material passes in a dispensing direction, wherein the first roller is displaceable between at least a first position and a second position, wherein a first distance is defined between the first roller and the second roller when the first roller is arranged in the first position, and a second distance is defined between the first roller and the second roller when the first roller is arranged in the second position;

the first position is a fixed position and the second position is a fixed position; and the first roller is mounted in a first cradle, the first cradle being movably arranged in the dispensing unit about a pivot point for selectively positioning the first roller in the first position and in the second position, the pivot point being located upstream of the first roller relative to the dispensing direction.

2. The dispensing unit according to claim 1, wherein the dispensing unit is adapted for dispensing of continuous web material when the first roller is in each of the first position and the second position.

3. The dispensing unit according to claim 1, wherein the first distance is smaller than the second distance.

4. The dispensing unit according to claim 3, wherein the dispensing unit is adapted for dispensing of perforated web material when the first roller is in the first position and for dispensing non-perforated web material when the first roller is in the second position.

5. The dispensing unit according to claim 1 , comprising a position controller being movable between a first setting and a second setting, wherein one of the first cradle and the position controller comprises a first cam surface and another of the first cradle and the position controller comprises a first cam follower arranged to abut against and follow the first cam surface to displace the first cradle, and wherein the first cradle is positioned such that the first roller is in the first position when the position controller is in the first setting, and the first cradle is positioned such that the first roller is in the second position when the position controller is in the second setting.

6. The dispensing unit according to claim 5, comprising a first visual indicator at an outer surface of the dispensing unit, wherein the position controller is arranged to interact with the first visual indicator to indicate the first position and the second position, respectively.

7. The dispensing unit according to claim 1, further comprising a tear-off arrangement for web material arranged downstream of the web passage, seen in a dispensing direction.

8. The dispensing unit according to claim 7, wherein the first roller is arranged to guide the web path clear of the tear-off arrangement in the first position and the first roller is arranged to expose the web path to the tear-off arrangement in the second position.

9. The dispensing unit according to claim1, wherein the second roller is mounted in a second cradle being movably arranged in the dispensing unit.

10. The dispensing unit according to claim 9, comprising a resilient element, wherein the second cradle is biased in a direction towards the first roller by the resilient element.

11. The dispensing unit according to claims claim 10, wherein the second cradle is movable in a direction away from the first roller against a biasing force of the resilient element in the respective third and fourth positions.

12. The dispensing unit according to claim 10, wherein the resilient element is mounted in a third cradle being movably arranged in the dispensing unit, and wherein the third cradle is arranged to be positioned in at least a fifth position and a sixth position, the fifth position being closer to the second cradle than the sixth position.

13. The dispensing unit according to claim 9, comprising:

a setting controller movable between a third setting and a fourth setting, wherein one of the second cradle and the setting controller comprises a second cam surface and one of the second cradle and the setting controller comprises a second cam follower arranged to abut against and follow the second cam surface to displace the second cradle, and wherein the second cradle is positioned such that the second roller is in a third position when the setting controller is in the third setting, and the second cradle is positioned such that the second roller is in a fourth position when the setting controller is in the fourth setting.

14. The dispensing unit according to claim 13, comprising a second visual indicator at an outer surface of the dispensing unit, wherein the setting controller is arranged to interact with the second visual indicator to indicate the third position and the fourth position, respectively.

15. The dispensing unit according to claim 1, wherein the first roller and the second roller comprise disc-shaped elements arranged at a distance from each other along the first and second axes, and wherein when the first roller is in the first position, the disc-shaped elements of the first roller overlap the disc-shaped elements of the second roller to form an undulated web passage between the first roller and the second roller.

16. The dispensing unit according to claim 15, wherein at least one of the disc-shaped elements, seen in a circumferential direction, comprises narrow portions and wide portions.

17. The dispensing unit according to claim 16, wherein the disc-shaped elements of the first roller and the second roller overlap each other 1.5-6 mm in the first position of the first roller.

18. The dispensing unit according to claim 1, wherein the continuous web material has a first width and the web passage has a second width in a direction parallel with the first axis, and wherein the second width is smaller than the first width.

19. A dispenser comprising a housing adapted to receive a roll of continuous web material, wherein the housing has a dispensing end, wherein the dispenser comprises a dispensing unit according to claim 1 arranged at the dispensing end, and wherein the web path extends from the dispensing end to, and through, the dispensing unit.

20. The dispenser according to claim 19, wherein the housing is adapted to receive a centre feed roll of continuous web material.

* * * * *